US005873179A

United States Patent [19]

Gregory et al.

[11] Patent Number: 5,873,179

[45] Date of Patent: Feb. 23, 1999

[54] BODY DRYING APPARATUS

[76] Inventors: Frederick Gregory; Michael P. Albanese, both of P.O. Box 65, Belleville, N.J. 07109

[21] Appl. No.: 961,902

[22] Filed: Oct. 31, 1997

Related U.S. Application Data

[60] Provisional application No. 60/029,207 Oct. 31, 1996.

[51] Int. Cl.[6] ..... F26B 19/00

[52] U.S. Cl. ..... 34/90; 34/91; 392/380; 392/381

[58] Field of Search ..... 34/90, 91, 233, 34/97, 225; 392/380, 381

[56] References Cited

U.S. PATENT DOCUMENTS

| | | | |
|---|---|---|---|
| 3,128,161 | 4/1964 | Hudon | 34/233 |
| 3,621,199 | 11/1971 | Goldstein | 219/370 |
| 3,878,621 | 4/1975 | Duerre | 34/90 |
| 4,558,526 | 12/1985 | Baus | 34/232 |
| 4,594,797 | 6/1986 | Houck, Jr. | 34/225 |
| 4,756,094 | 7/1988 | Houck, Jr. | 34/225 |
| 4,780,595 | 10/1988 | Alban | 219/370 |
| 4,871,900 | 10/1989 | Hickman | 219/366 |
| 4,961,272 | 10/1990 | Lee | 34/90 |
| 5,003,705 | 4/1991 | Lee | 34/54 |
| 5,007,182 | 4/1991 | Fishman et al. | 34/90 |
| 5,009,587 | 4/1991 | Jarosch | 34/202 |
| 5,103,577 | 4/1992 | Michaels et al. | 34/91 |
| 5,269,071 | 12/1993 | Hamabe et al. | 34/48 |
| 5,651,189 | 7/1997 | Coykendall et al. | 34/90 |

*Primary Examiner*—Henry A. Bennett
*Assistant Examiner*—Pamela A. Wilson

[57] ABSTRACT

The present invention includes an apparatus for removing moisture from at least one user including a first set of riser ducts having openings, a first frame supporting the first set of riser ducts, each one of the first set of riser ducts having an elongated, tapered configuration allowing the volumetric capacity to decrease along a length thereof, and a first face plate arranged opposite the first set of riser ducts and having slots corresponding with the openings of the first set of riser ducts. The apparatus further including a first set of connecting duct segments communicating with the first set of riser ducts, respectively, each one of the first connecting duct segments having a length corresponding with each one of the first set of riser ducts, respectively, at least one motor for discharging air to the first set of connecting duct segments, and at least one heater for heating the air discharged by said at least one motor. The present invention provides each one of the holes of the first set of riser ducts ejecting a uniform velocity of air flow resulting in a uniform wall.

16 Claims, 2 Drawing Sheets

BODY DRYING APPARATUS

This application claims the benefit of U.S. Provisional Application No. 60/029,207, filed Oct. 31, 1996.

BACKGROUND OF THE INVENTION

1. Field of Invention

This invention pertains to an air drying device, specifically relating to blowing heated air to dry the full body of a person.

2. Prior Art

Hand and hair dryers have been in use by the general public for some time. For the most part such dryers consist of a heating element, a blower or fan and a motor. The hand dryer type are usually found in public washrooms and are normally mounted on a wall. One advantage of dryers over towel drying is that it is generally more sanitary and cost efficient. Other dryers, which vary in design, are for drying the entire body of a person. Examples of such conventional dryers are U.S. Pat. No. 3,128,161; U.S. Pat. No. 4,961,272; U.S. Pat. No. 5,003,705 and U.S. Pat. No. 5,009,587 which may be efficient in certain aspects; however such conventional devices do not make use of space saving slender air panels and, thus, may not be as practical for use in applications such as the Health Care Industry. U.S. Pat. No. 4,871,900 depicts a dryer used for the elderly or infirmed but does not make use of space saving slender air panels. Other prior art such as U.S. Pat. No. 4,780,595; U.S. Pat. No. 5,007,182; and U.S. Pat. No. 5,651,189 are directed towards portable body dryers for full body drying which would entail moving such devices from a storage place to the bath area each time needed. Also, U.S. Pat. No. 5,103,577 illustrates a heater/dryer device for the human body although being limited in the area of coverage it can dry at one time.

While all these devices work to dry the hands, hair and body to one degree or another, each one is limited in its ability to serve the user as a body dryer for which they were developed.

SUMMARY OF THE INVENTION

The present invention is to provide a more efficient and convenient apparatus than the prior art for uniformly drying the entire body of a person or persons by the use of hot air. More particularly, one aspect of the present invention comprises an apparatus for removing moisture from a user including a first air distribution panel having a first set of riser ducts, a first support frame, and a first face panel. The first set of riser ducts having a plurality of openings and the first support frame supports the first set of riser ducts. The present invention further includes each one of the first set of riser ducts having an elongated, tapered configuration allowing a volumetric capacity to decrease along a length thereof. The first face panel of the first air distribution panel are arranged opposite the first set of riser ducts and having a plurality of slots which correspond with the plurality of openings of the first set of riser ducts. Additionally, the first set of connecting duct segments communicates with the first set of riser ducts, respectively; and each one of the first connecting duct segments having a length corresponding with each one of the first set of riser ducts, respectively. The present invention further includes at least one motor for discharging air to the first set of connecting duct segments and at least one heater for heating the air discharged from the at least one motor. Each one of the plurality of holes of the first set of riser ducts ejects a uniform velocity of air flow resulting in a uniform wall of air for removing the moisture from the user.

In another aspect of the present invention, the apparatus further includes a second air distribution panel including a second set of riser ducts, a second support frame, and a second face panel. The second set of riser ducts having a plurality of openings and the second support frame supports the second set of riser ducts. Each one of the second set of riser ducts having an elongated, tapered configuration allowing a volumetric capacity to decrease along a length thereof. The second face panel arranged opposite the second set of riser ducts and having a plurality of slots which correspond with the plurality of openings of the second set of riser ducts. The present invention further includes a second set of connecting duct segments communicating with the second set of riser ducts, respectively. Each one of the second connecting duct segments having a length corresponding with each one of the second set of riser ducts, respectively, and a second heater for heating the air discharged from the at least one motor. Each one of the plurality of holes of the second set of riser ducts ejects a uniform velocity of air flow resulting in a uniform wall of air for removing the moisture from the user.

In yet another aspect of the present invention, the first air distribution panel and the second air distribution panel are mounted to a first and second wall, respectively, and the first air distribution panel and the second air distribution panel are arranged perpendicular to each other.

An advantage of the present invention is to enable one to independently dry oneself in a convenient, hands free manner with a minimal amount of movement and to allow wheelchair type access for patients in a health care facility.

Another advantage of the present invention is to provide a practical unobtrusive full body dryer mounted on or in the wall of a home, hospital or health care facility such as a nursing home. In addition to personal home use, it is intended for patients where towel drying is not practical or medically advised. This apparatus may also be used by invalids, paraplegics or other people for which its is difficult or almost impossible to towel dry themselves.

Another object of this invention is to minimize the space needed, yet provide uniform air flow and uniform velocity from a device having a decorative design that blends with its surroundings. Further embodiments and understanding of the present invention will become apparent from the following detailed description and drawings of the invention.

DETAILED DESCRIPTION OF THE INVENTION

Figure 1:
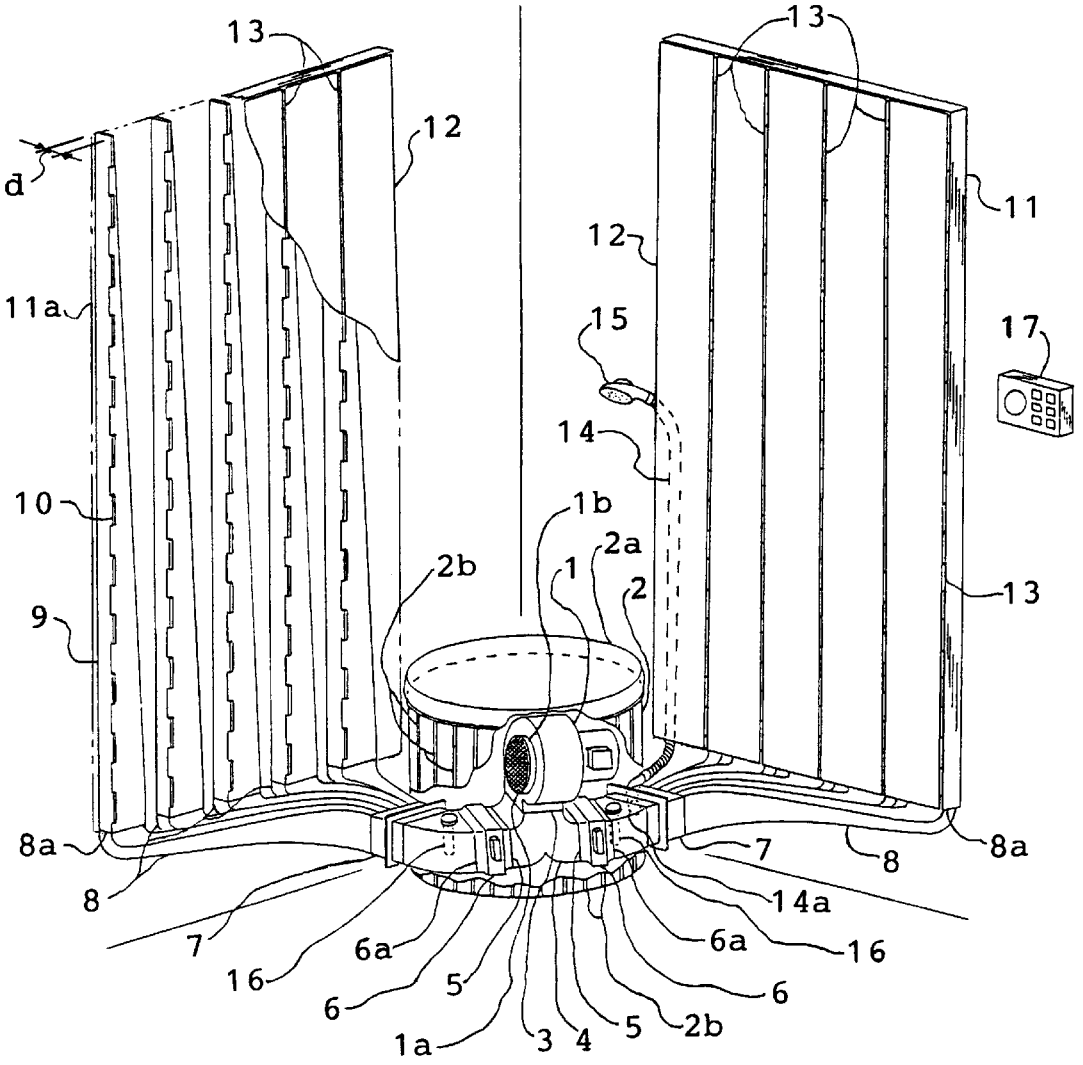
FIG. 1 is a perspective view of a body drying apparatus in accordance with the present invention.

FIG. 1 shows a perspective view of an embodiment of the present invention including an air distribution panel 11*a*. The air distribution panel 11*a* as depicted in FIG. 2 includes a plurality of riser ducts 9, a support frame 11, and a face panel 12.

Figure 2:
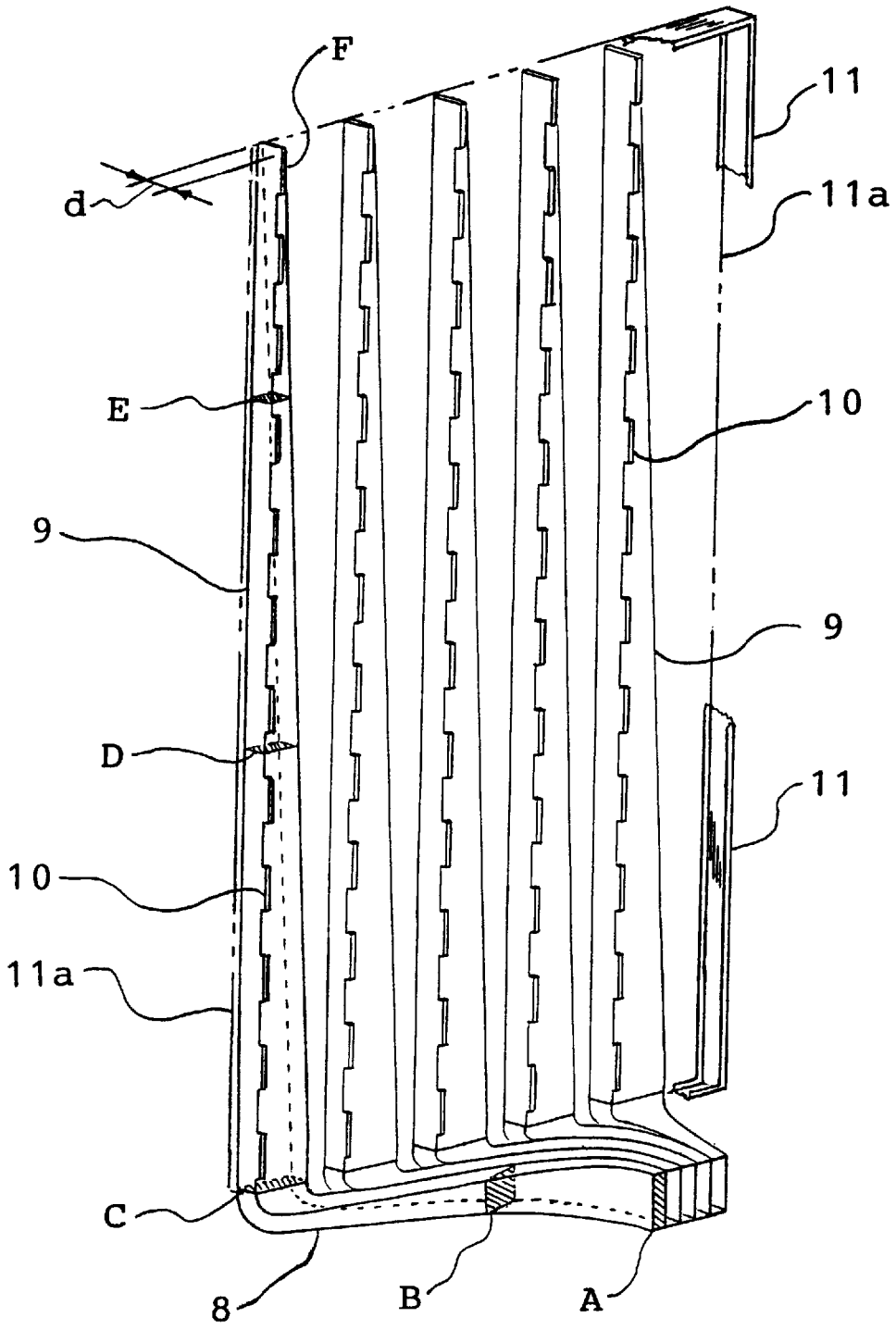
FIG. 2 is a perspective view of an air distribution panel and connecting duct segments.

As shown in FIGS. 1 and 2, each of the plurality of riser ducts 9 are specifically tapered and of an elongated shape having a closed off top end and an opening at an inlet end. Additionally, each one of the riser ducts 9 corresponds with each one of the connecting duct segments 8, respectively. The geometric and dimensional construction of the riser ducts 9 and its correspondence with each one of the connecting duct segments 8, respectively, allows uniform air flow without the need for baffles, dampers, throttles or valves. Such a construction is less costly to manufacture, more efficient and requires little or no maintenance. Additionally, each of the riser ducts 9 can be of similar shape and size further enabling them to be mass produced in a less costly manner. Each one of the plurality of riser ducts 9 include a plurality of openings 10 which act as air flow nozzles.

As shown in FIGS. 1 and 2, the support frame 11 supports the plurality of riser ducts 9 and receives and supports a face panel 12 which covers and encloses the plurality of riser ducts 9. The face panel 12 includes a plurality of vertical openings or slots 13 arranged opposite the plurality of openings of each of the plurality of riser ducts 9 allowing air to flow from the plurality of openings 10 of the riser ducts 9. The face panel 12 can be constructed of marble, ceramic, decorative fabric, plastic, wood, metal and the like.

Each one of the lengths of the connecting duct segments 8 correspond with a respective one of the plurality of riser ducts 9. Additionally, the connecting duct segments 8 are substantially the same size and have a tapered type configuration which can change in size, shape and direction to enable the same volume of air at the inlet of each one of the plurality of riser ducts 9. In one embodiment, the connecting duct segments 8 vary in length with respect to one another.

As illustrated in FIG. 2, a volume of air within the connecting duct segments 8 continually decreases along its length. For example, in operation the volume of air at point A is greater than the volume of air at point B, and the volume of air at point B is greater than the volume of air at point C, and thus, enabling the same volume of air at the inlet of each one of the plurality of riser ducts 9. This is typical for each of the plurality of connecting duct segments 8.

The outlet end 8*a* of connecting duct segments 8 is connected to the inlet of the plurality of riser ducts 9 of the air distribution panel 11*a*. As shown in FIG. 2, in operation, a volume of air exits connecting duct segments 8 at point C and enters the riser ducts 9 and continually discharges air through the nozzle openings 10. As the air exits through the nozzles 10 of the riser ducts 9 the volume of air continually decreases as it passes point D, E and F. The velocity of air at each one of the plurality of nozzles 10 remains uniform and constant. Collectively the plurality of openings from each of the plurality of riser ducts 9 provide a uniform air flow over the entire surface area of the air distribution panel 11*a* creating a constant uniform wall of air directed towards a user or users. Moreover, the air distribution panel 11*a* is able to provide such a constant uniform wall of air without requiring baffles, dampers, throttles or valves.

The construction and correspondence between the riser duct 9 and connecting duct segments 8 allow the air distribution panel 11*a* to have a slender construction and provide a wall of uniform air flow and velocity. In one embodiment, a thickness, d, of the air distribution panel 11*a* is in the range between ½ inch and 4 inches. In another embodiment, d, equals approximately 1 inch.

The air distribution panel 11*a* including the plurality of riser ducts 9 extends vertically to a height to accommodate a user, for example, slightly above the height of an average person. The plurality of riser ducts 9 are equally spaced allowing the width of the air distribution panel 11*a* approximately equal to that of an average door. In one embodiment, for example, air distribution panel 11*a* has a height of approximately 6'–3" and a width of 2'–8".

In a preferred embodiment, as shown in FIG. 1, the present invention includes two air distribution panels 11*a* for example, a first air distribution panel and a second distribution panel, which can be mounted on two separate walls and arranged perpendicular to each other. Such an arrangement will allow two uniform walls of air ensuring a more efficient air flow from two directions over the entire body of the user. Further, each support frame 11 is mounted onto two perpendicular walls, respectively, near their corner and adjacent to seat housing 2. Additionally, a blower/motor assembly 1 can be mounted within and/or enclosed by a seat housing 2 and positioned near the corner of a location where the body drying apparatus is assembled. More specifically, the blower/motor assembly 1 can be positioned equidistant from each of the air distribution panels 11*a*, as shown in FIG. 1.

The seat housing 2 includes, in one embodiment, a cushion top 2*a* and a permeable surface 2*b* which allows air to be drawn into blower 1 through an air filter 1*a* mounted onto the air inlet suction port 1*b*. The air exiting the blower 1 is forced through a fitting 4 and can be heated as it passes through heaters 6, into connecting duct 7 to riser duct 9, then out towards a user or users.

In an alternate embodiment, the blower/motor assembly 1, heaters 6 and connecting duct segments 7 can be located behind the walls without the use of seat housing 2. Thus, only the face panel 12 of the air distribution panel 11*a* is visible to the user.

Attached to the air outlet discharge port 3 of blower 1 is a duct fitting 4 such as a tee-type fitting having three openings. At either end of the two remaining tee openings 5 are placed heaters 6. Attached to either end of heaters 6 outlet port 6*a* is one of the connecting ducts 7 which connects to the plurality of connecting duct segments 8.

An opening 14*a* can be provided in one connecting duct 7 for attaching a flexible hose 14 having a nozzle 15 for controlling the flow of air through the hose 14. Positioned in each connecting duct 7 and adjacent to the heaters 6 is a sterilizing lamp 16 such as an ultraviolet lamp that emits bactericidal ultraviolet radiation which kills germs, bacteria and the like which have entered with the supply air into connecting duct 7.

Further, the present invention may include a control panel 17 which can be amounted on a wall and located near an air distribution panel 11*a* is provided for controlling air flow, temperature, sterilizer lamp, and cycle time duration.

The forgoing detailed description of the present invention is for purposes of illustration and description. It is not intended to limit the invention to the precise forms disclosed. In light of the above teachings, many modifications are possible. It is intended that the scope of the invention be limited not by this detailed description, but rather by the appended claims and their legal equivalents.

We claim:

1. An apparatus for removing moisture from a user or users comprising:

a first air distribution panel including a first set of riser ducts, a first support frame, and a first face panel;

said first set of riser ducts of said first air distribution panel having a plurality of openings;

said first support frame of said first distribution panel supporting said first set of riser ducts;

each one of said first set of riser ducts of said first air distribution panel having an elongated, tapered configuration allowing a volumetric capacity to decrease along a length thereof;

said first face panel of said first air distribution panel arranged opposite said first set of riser ducts and having a plurality of slots which correspond with said plurality of openings of said first set of riser ducts;

a first set of connecting duct segments communicating with said first set of riser ducts of said first air distributing panel, respectively;

each one of said first connecting duct segments having a length corresponding with each one of said first set of riser ducts, respectively;

at least one motor for discharging air to said first set of connecting duct segments;

at least one heater for heating the air discharged from said at least one motor;

wherein each one of said plurality of holes of said first set of riser ducts ejects an uniform velocity of air flow resulting in an uniform wall of air for removing the moisture from the user.

2. The apparatus according to claim 1, further comprising:

a second air distribution panel including a second set of riser ducts, a second support frame, and a second face panel;

said second set of riser ducts of said second air distribution panel having a plurality of openings;

said second support frame of said second air distributing panel supporting said second set of riser ducts;

each one of said second set of riser ducts having an elongated, tapered configuration allowing a volumetric capacity to decrease along a length thereof;

said second face panel of said second air distribution panel arranged opposite said second set of riser ducts and having a plurality of slots which correspond with said plurality of openings of said second set of riser ducts;

a second set of connecting duct segments communicating with said second set of riser ducts, respectively;

each one of said second connecting duct segments having a length corresponding with each one of said second set of riser ducts, respectively;

a second heater for heating the air discharged from said at least one motor;

wherein each one of said plurality of holes of said second set of riser ducts ejects an uniform velocity of air flow resulting in a uniform wall of air for removing the moisture from the user.

3. The apparatus according to claim 2, wherein said first air distribution panel and said second air distribution panel are mounted to a first and second wall, respectively, and said first air distribution panel and said second air distribution panel are arranged perpendicular to each other.

4. The apparatus according to claim 3, wherein each of said first and second air distribution panels having a thickness of less than four inches.

5. The apparatus according to claim 4, wherein each of said first and second air distribution panels having a thickness of less than one inch.

6. The apparatus according to claim 3, wherein the length of each one of said first set of connecting duct segments is different from an adjacent one of said first set of connecting duct segments, the length of each one of said second set of connecting duct segments is different from an adjacent one of said second set of connecting duct segments, each of said first connecting duct segments provides each one of said first set of riser ducts with the same volume of air, respectively, and each of said second connecting duct segments provides each one of said second set of riser ducts with the same volume of air, respectively.

7. The apparatus according to claim 3, wherein said at least one motor is located equidistant from said first and second air distribution panel.

8. The apparatus according to claim 1, wherein said first air distribution panel having a thickness of less than four inches.

9. She apparatus according to claim 8, wherein said first air distribution panel having a thickness of less than one inch.

10. The apparatus according to claim 1, wherein the length of each one of said first set of connecting duct segments is different from an adjacent one of said first set of connecting duct segments and each of said first connecting duct segments provides each one of said first set of riser ducts with the same volume of air, respectively.

11. The apparatus according to claim 1, wherein each one of said first set of ducts are substantially the same size, shape and dimension.

12. The apparatus according to claim 1, further comprising a multipurpose seat housing, including an air permeable surface for allowing air to pass to said at least one motor, protecting said at least one motor and the user from being harmed, and enabling the user to sit.

13. The apparatus according to claim 1, further comprising a light for sanitizing the air discharged by said at least one motor.

14. The apparatus according to claim 1, further comprising a filter for filtering at least one of air passing to said at least one motor and the air discharged by said at least one motor.

15. The apparatus according to claim 1, further comprising a control panel.

16. The apparatus according to claim 1, further comprising a flexible hose for drying any part of a body of the user.

* * * * *